US009330623B2

(12) United States Patent
Lee et al.

(10) Patent No.: US 9,330,623 B2
(45) Date of Patent: May 3, 2016

(54) DISPLAY DEVICE AND METHOD FOR DRIVING THE SAME

(71) Applicant: Samsung Display Co., Ltd., Yongin (KR)

(72) Inventors: Donggyu Lee, Seoul (KR); Joon-Chul Goh, Hwaseong-si (KR); Nam-Gon Choi, Yongin-si (KR); Jung-Won Kim, Seoul (KR); HongSoo Kim, Hwaseong-si (KR); Geunjeong Park, Daegu (KR)

(73) Assignee: Samsung Display Co., Ltd., Yongin-si (KR)

( * ) Notice: Subject to any disclaimer, the term of this patent is extended or adjusted under 35 U.S.C. 154(b) by 140 days.

(21) Appl. No.: 14/175,440

(22) Filed: Feb. 7, 2014

(65) Prior Publication Data

US 2015/0077406 A1 Mar. 19, 2015

(30) Foreign Application Priority Data

Sep. 17, 2013 (KR) ..... 10-2013-0111883

(51) Int. Cl.
*G09G 3/36* (2006.01)
*G09G 3/00* (2006.01)

(52) U.S. Cl.
CPC ..... *G09G 3/3648* (2013.01); *G09G 3/007* (2013.01); *G09G 2320/0257* (2013.01); *G09G 2320/103* (2013.01)

(58) Field of Classification Search
CPC ..... G09G 3/30; G09G 3/32; G09G 3/36; G09G 3/20; G09G 5/00; G09G 5/10; G06F 17/00; G06F 17/20; G06F 3/048; G06F 3/00; G06F 3/14; G06F 3/038
See application file for complete search history.

(56) References Cited

U.S. PATENT DOCUMENTS

| | | | | |
|---|---|---|---|---|
| 6,937,224 | B1 | 8/2005 | Miyachi | |
| 7,002,539 | B2 | 2/2006 | Shimada | |
| 7,106,350 | B2 | 9/2006 | Baba et al. | |
| 8,264,451 | B2 | 9/2012 | Kimura | |
| 2005/0068288 | A1* | 3/2005 | Jang | G09G 3/2092 345/100 |
| 2005/0204313 | A1* | 9/2005 | Enoki | G09G 3/007 715/867 |
| 2009/0243995 | A1* | 10/2009 | Kimura | G09G 3/342 345/102 |
| 2009/0273553 | A1 | 11/2009 | Song et al. | |
| 2010/0103089 | A1* | 4/2010 | Yoshida | G09G 3/2022 345/102 |

FOREIGN PATENT DOCUMENTS

| | | |
|---|---|---|
| JP | 2001-265299 | 9/2001 |
| KR | 10-2005-0105574 | 11/2005 |
| KR | 10-0555672 | 3/2006 |
| KR | 10-2007-0062836 | 6/2007 |

* cited by examiner

*Primary Examiner* — Pegeman Karimi
(74) *Attorney, Agent, or Firm* — H.C. Park & Associates, PLC

(57) ABSTRACT

A display device including a display panel which includes pixels connected to gate lines and data lines; and an image display control unit controlling an input image signal to be converted into a data signal and, thereby, display an image on the display panel. The image display control unit outputs the data signal so that a position of an image being displayed on the display panel is changed when the image signal is the same for a preselected time period and sets a next position change time period of the image according to a distance between an original position of the image and a changed position of the image.

18 Claims, 12 Drawing Sheets

Fig. 3

PX

110

| (-4,-4) | (-3,-4) | (-2,-4) | (-1,-4) | (0,-4) | (1,-4) | (2,-4) | (3,-4) | (4,-4) |
|---|---|---|---|---|---|---|---|---|
| (-4,-3) | T=2t (-3,-3) | T=2t (-2,-3) | T=2t (-1,-3) | T=2t (0,-3) | T=2t (1,-3) | T=2t (2,-3) | T=2t (3,-3) | (4,-3) |
| (-4,-2) | T=2t (-3,-2) | T=3t (-2,-2) | T=3t (-1,-2) | T=3t (0,-2) | T=3t (1,-2) | T=3t (2,-2) | T=2t (3,-2) | (4,-2) |
| (-4,-1) | T=2t (-3,-1) | T=3t (-2,-1) | T=4t (-1,-1) | T=4t (0,-1) | T=4t (1,-1) | T=3t (2,-1) | T=2t (3,-1) | (4,-1) |
| (-4,0) | T=2t (-3,0) | T=3t (-2,0) | T=4t (-1,0) | T=5t (0,0) | T=4t (1,0) | T=3t (2,0) | T=2t (3,0) | (4,0) |
| (-4,1) | T=2t (-3,1) | T=3t (-2,1) | T=4t (-1,1) | T=4t (0,1) | T=4t (1,1) | T=3t (2,1) | T=2t (3,1) | (4,1) |
| (-4,2) | T=2t (-3,2) | T=3t (-2,2) | T=3t (-1,2) | T=3t (0,2) | T=3t (1,2) | T=3t (2,2) | T=2t (3,2) | (4,2) |
| (-4,3) | T=2t (-3,3) | T=2t (-2,3) | T=2t (-1,3) | T=2t (0,3) | T=2t (1,3) | T=2t (2,3) | T=2t (3,3) | (4,3) |
| (-4,4) | (-3,4) | (-2,4) | (-1,4) | (0,4) | (1,4) | (2,4) | (3,4) | (4,4) |

DISPLAY DEVICE AND METHOD FOR DRIVING THE SAME

CROSS-REFERENCE TO RELATED APPLICATION

This application claims priority from and the benefit of Korean Patent Application No. 10-2013-0111883, filed on Sep. 17, 2013, which is hereby incorporated by reference for all purposes as if fully set forth herein.

BACKGROUND

1. Field

Exemplary embodiments of the present invention relate to display devices.

2. Discussion of the Background

A display device is generally used in a personal computer, a television, etc. Recently, display devices have been utilized in the expanding field of a digital information display (DID) for digital signage, such as a personal digital frame, an advertising board used commercially, or an information desk used in a public place. A display device for digital signage continuously operates for an extended period of time, and may typically display a still image for a relatively long period of time.

A liquid crystal display device of an active matrix type driving a liquid crystal cell using a thin film transistor (TFT) has advantages of a superior image quality and low power consumption. A liquid crystal display device of an active matrix type is rapidly evolving into higher resolutions and larger sizes by securing mass production technology and research and development performance. When a liquid crystal device is used as a display device for a digital signage, if an image is changed after a preselected still image is displayed for a relatively long period of time, the previous image may remain as an example of what is commonly referred to as "image retention".

The above information disclosed in this Background section is only for enhancement of understanding of the background of the invention and, therefore, it may contain information that does not form the prior art that is already known in this country to a person of ordinary skill in the art.

SUMMARY

Exemplary embodiments of the present invention provide a display device having lower image retention, and a method for driving the same.

Additional aspects will be set forth in part in the description which follows and, in part will be apparent from the description, or may be learned by practice of the invention.

An exemplary embodiment of the present invention discloses a display device including a display panel including pixels connected to gate lines and data lines; and an image display control unit configured to control an image signal input from an external source such that the image signal is converted into a data signal, thereby displaying an image on the display panel. The image display control unit outputs the data signal so that a position of an image being displayed on the display panel is changed when the image signal remains the same for a specified period of time, and sets a next position change time period of the image according to a distance between an original position of the image and a changed position of the image.

An exemplary embodiment of the present invention also discloses a method of driving a display device. The method may include receiving an image signal of a previous frame as a previous image signal and an image signal of a current frame as a current image signal; counting up a first counter and outputting a first count signal when the previous image signal coincides with the current image signal; counting up a second counter and outputting a second count signal when the first count signal is greater than a first reference value; converting the current image signal into a data signal so that a position of an image being displayed on the display panel is changed when the second count signal is greater than a second reference value; and changing the second reference value according to a distance between an original position of the image and a changed position of the image.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate exemplary embodiments of the invention, and together with the description serve to explain the principles of the invention.

FIG. 3 is a drawing illustrating an example of a display panel illustrated in FIG. 1.

DETAILED DESCRIPTION OF THE ILLUSTRATED EMBODIMENTS

Figure 1:
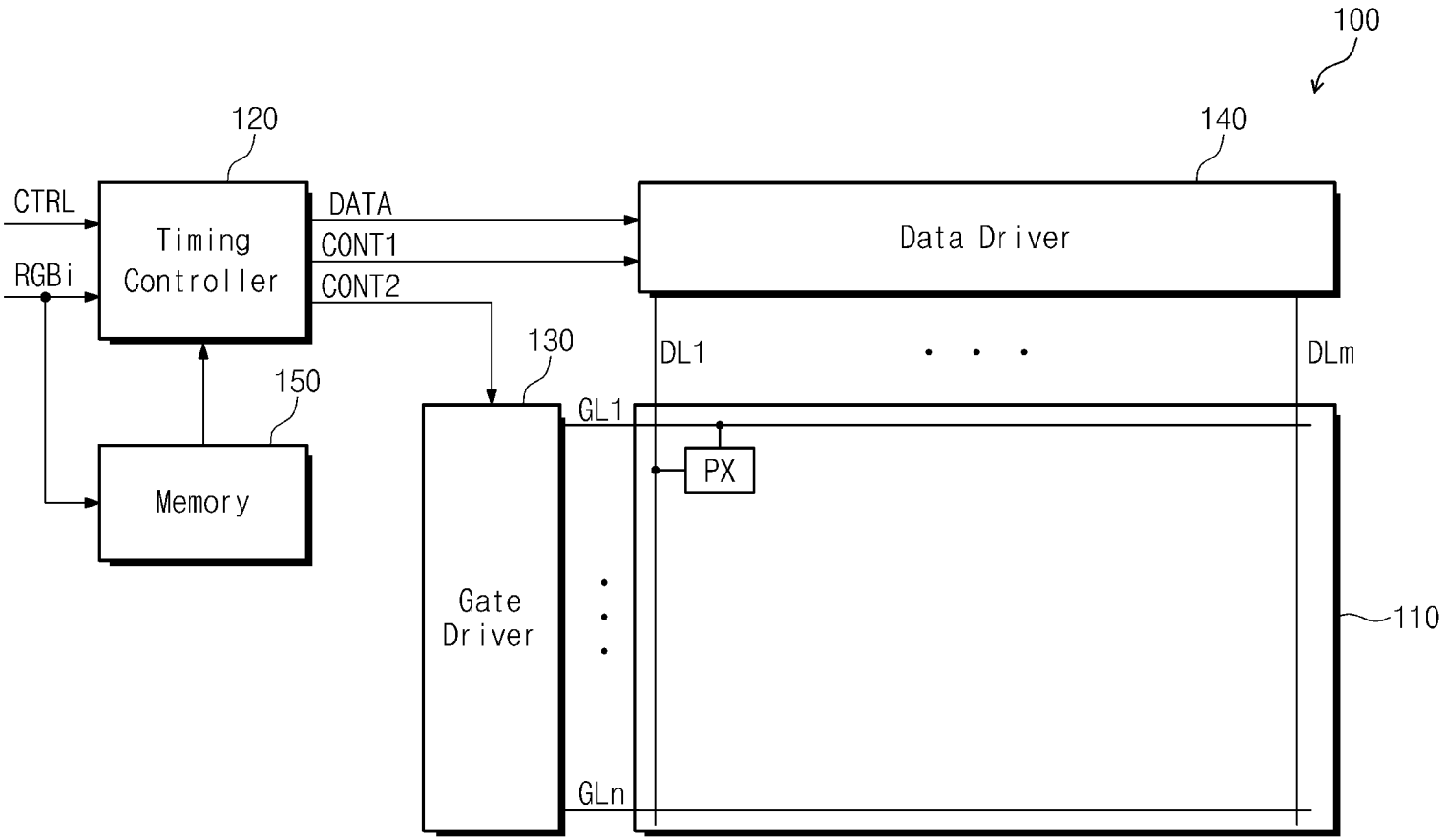
FIG. 1 is a block diagram illustrating a display device according to an exemplary embodiment of the present invention.

The present invention will be described more fully hereinafter with reference to the accompanying drawings, in which exemplary embodiments of the invention are shown. This invention may, however, be embodied in many different forms and should not be construed as limited to the exemplary embodiments set forth herein. Rather, these exemplary embodiments are provided so that this disclosure is thorough, and will fully convey the scope of the invention to those skilled in the art. In the drawings, the size and relative sizes of layers and regions may be exaggerated for clarity. Like reference numerals in the drawings denote like elements.

It will be understood that when an element or layer is referred to as being "on", "connected to", or "coupled to" another element or layer, it can be directly on, directly connected to, or directly coupled to the other element or layer, or intervening elements or layers may be present. In contrast, when an element is referred to as being "directly on," "directly connected to", or "directly coupled to" another element or layer, there are no intervening elements or layers present. It will be understood that for the purposes of this disclosure, "at least one of X, Y, and Z" can be construed as X only, Y only, Z only, or any combination of two or more items X, Y, and Z (e.g., XYZ, XYY, YZ, ZZ).

FIG. 1 is a block diagram illustrating a display device according to an exemplary embodiment of the present invention. A liquid crystal display device is illustrated and explained as an example of the display device below. However, the inventive concept is not limited to the liquid crystal display device and can be applied to various types of display devices.

Referring to FIG. 1, a display device 100 includes a display panel 110, a timing controller 120, a gate driver 130, a data driver 140, and a memory 150. The timing controller 120, the gate driver 130, and the data driver 140 may collectively be referred to as an "image display control unit". The image display control unit converts an image signal RGBi being input from an external source into a data signal DATA to thereby display an image on the display panel 110.

The display panel 110 includes data lines DL1~DLm, gate lines GL1~GLn which cross the data lines DL1~DLm, and pixels arranged at crossing regions thereof. In FIG. 1, only a representative pixel PX connected to the data line DL1 and the gate line GL1 is illustrated.

The timing controller 120 is provided with an image signal RGBi from an external source, and control signals CTRL (e.g., a vertical synchronizing signal, a horizontal synchronizing signal, a main clock signal and a data enable signal) for controlling a display of the image signal RGBi. The timing controller 120 provides a data signal DATA containing the image signal RGBi that is processed to be suited to an operation condition of the display panel 110, a first control signal CONT1 based on the control signals CTRL provided to the data driver 140, and a second control signal CONT2 based on the control signals CTRL provided to the gate driver 130. The first control signal CONT1 may include a clock signal, a polarity reversal signal, and a line latch signal, and the second control signal CONT2 may include a vertical synchronizing signal, an output enable signal, and a gate pulse signal.

The gate driver 130 drives the gate lines GL1~GLn in response to the second control signal CONT2 from the timing controller 120. The gate driver 130 can be embodied by an integrated circuit (IC) to be mounted on the display panel 110 by a chip on glass (COG) method, or to be mounted on a film (not shown) attached to the display panel 110 by a chip on film (COF) method. The gate driver 130 can be embodied by not only an integrated chip circuit, but also a circuit using an amorphous silicon gate (ASG) using an amorphous silicon thin film transistor (a-Si TFT), an oxide semiconductor, a crystalline semiconductor, or a polycrystalline semiconductor, etc.

The data driver 140 drives the data lines DL1~DLm in response to the data signal DATA and the first control signal CONT1 from the timing controller 120.

The memory 150 stores data for an operation of the timing controller 120. For example, the memory 150 stores the image signal RGBi being input from an external source.

The timing controller 120 outputs the data signal DATA so that a position of an image being displayed on the display panel 110 is changed when the image signal RGBi is the same for a preselected period of time, and sets a "next position change time period" of the image according to a distance between an original position and a changed position of the image.

Figure 2:
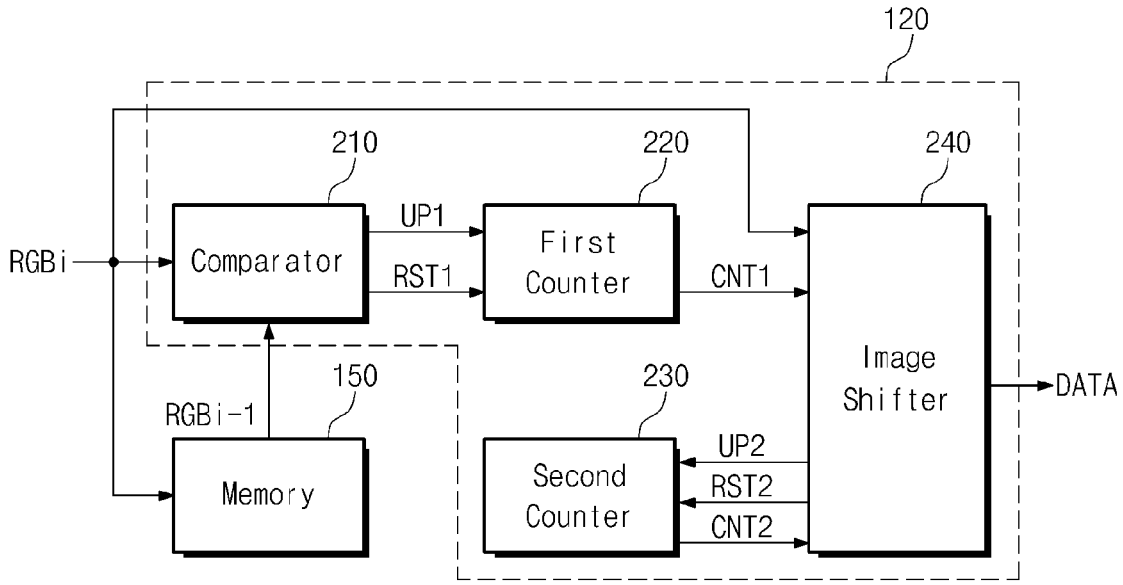
FIG. 2 is a block diagram illustrating a detailed constitution of a timing controller illustrated in FIG. 1.

FIG. 2 is a block diagram illustrating a detailed constitution of the timing controller illustrated in FIG. 1.

Referring to FIG. 2, the timing controller 120 includes a comparator 210, a first counter 220, a second counter 230, and an image shifter 240. The memory 150 stores an image signal RGBi of a current frame being input from an external source, and provides an image signal RGBi−1 of a previous frame to the comparator 210. The image signal RGBi of the current frame is referred to as a "current image signal RGBi", and the image signal RGBi−1 of the previous frame is referred to as "a previous image signal RGBi−1".

The comparator 210 receives the current image signal RGBi and the previous image signal RGBi−1, and outputs a first count up signal UP1 when the current image signal RGBi coincides with the previous image signal RGBi−1. The first count up signal UP1 may be a pulse signal. The comparator 210 outputs a first reset signal RST1 when the current image signal RGBi does not coincide with the previous image signal RGBi−1.

The first counter 220 operates in response to the first count up signal UP1 from the comparator 210, and outputs a first count signal CNT1. The first counter 220 is reset in response to a first reset signal RST1 from the comparator 210. For example, if the first reset signal RST1 transits to a first level, the first counter 220 resets the first count signal CNT1 to '0'.

If the first count value CNT1 is greater than a first reference value REF1, the image shifter 240 outputs a second count up signal UP2. The second count up signal UP2 may be a pulse signal. When a second count signal CNT2 from the second counter 230 is greater than a second reference value REF2, the image shifter 240 shifts the current image signal RGBi to output the data signal DATA and outputs a second reset signal RST2.

The second counter 230 operates in response to the second count up signal UP2 and outputs the second count signal CNT2. The second counter 230 is reset in response to the second reset signal RST2 from the image shifter 240. For example, if the second reset signal RST2 transits to a first level, the second counter 230 resets the second count signal CNT2 to '0'.

FIG. 3 is a drawing illustrating an example of a display panel illustrated in FIG. 1. Referring to FIG. 3, the display panel 110 includes pixels in a 9×9 matrix. For explanation purposes, the display panel 110 is described as including pixels in a 9×9 matrix, but the present invention can be applied to various sizes of display panels, such as 1600×1200, 1920×1080, 2560×1440, 2880×1800, etc.

If a coordinate of a central position of the display panel 110 is (0, 0), coordinates of the pixels of the 9×9 matrix can be represented by (−4, −4) through (4, 4). In the case that the image shifter 240 illustrated in FIG. 2 does not shift an image, a central position C of an image is (0, 0). The image shifter 240 can move an image being displayed on the display panel 110 by a pixel unit, and can shift an image by maximum k number of pixels (k is a positive integer). A case of k=3 is described below as an illustration. Thus, the image shifter 240 can move the central position C of the image by (−3, −3) from (0, 0) toward a left top; by (−3, 3) from (0, 0) toward a left bottom; by (3, 3) from (0, 0) toward a right bottom; and by (3, −3) from (0, 0) toward a right top. Moving a central position C of an image means that not only the central position of the image, but also the entire image being displayed on the display panel 110 is moved.

The image shifter 240 can set a "next position change time period" of an image according to a central position C of an image being displayed on the display panel 110. In FIG. 3, T represents a "next position change time period". For instance, when a central position C of an image is (0, 0), a "next position change time period" T is 5t, where t is a multiple of a period for one frame. When a central position C of an image is (−2, −2), a "next position change time period" T is 4t. If a period of one frame is referred to as "F", t is one of 1F, 2F, 3F, . . . . For instance, assuming that t=1F, when a central position C of an image is (0, 0), a "next position change time period" T is 5F. The image shifter 240 outputs the data signal DATA so that a next image is shifted after repeatedly displaying an image in which a central position C is (0, 0) and at the same position for five frames. When t=1F and a central position C of a current image is (−2, −2), the image shifter 240 outputs the data signal DATA so that a next image is shifted after repeatedly displaying an image of which a central position C is (0, 0) and at the same position for three frames. In this exemplary embodiment, a "next position change time period" T, according to the central position C of the image is a second reference value REF2 of the image shifter 240. The image shifter 240 may further include a register or a memory for storing the second reference value REF2.

Figure 4:
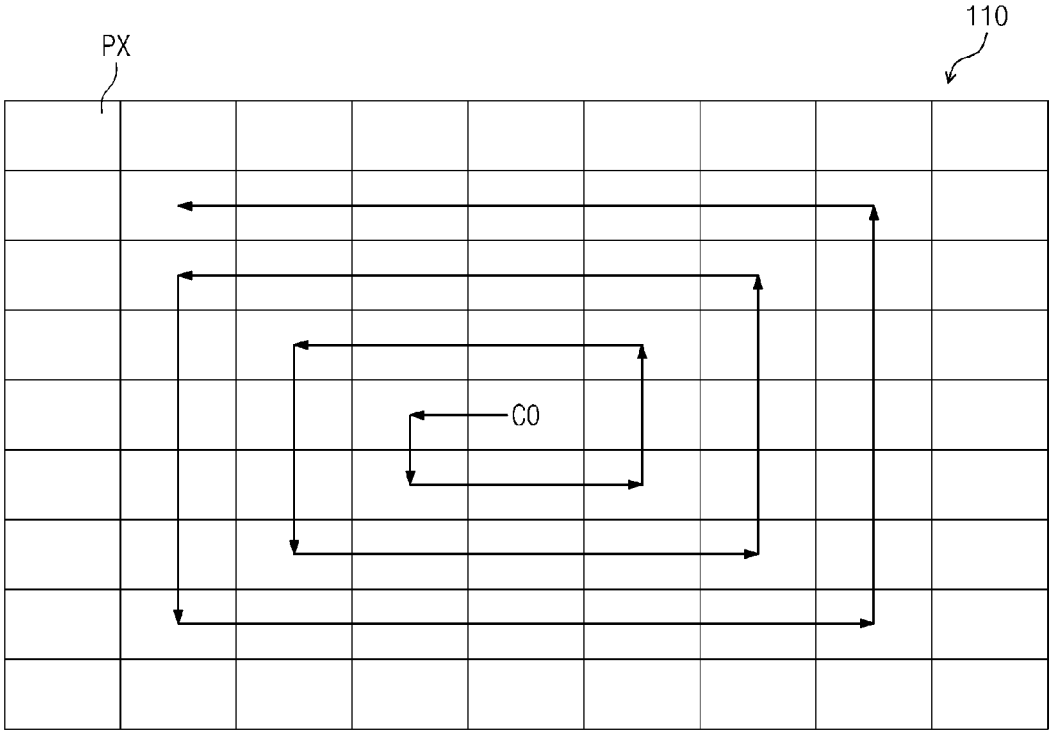
FIG. 4 is a drawing illustrating the order in which a central position of an image is changed.
Figure 5:
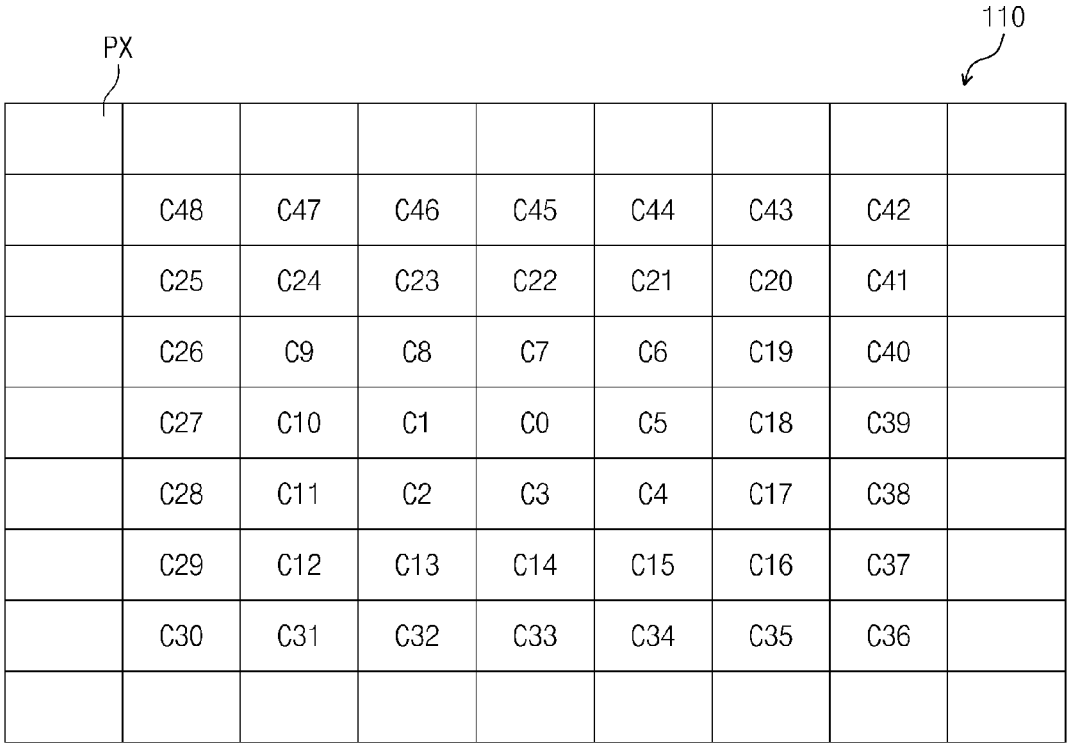
FIG. 5 is a drawing representing a central position of an image by a sign when the central position of the image is changed in the order illustrated in FIG. 4.

FIG. 4 is a drawing illustrating an order in which a central position of an image is changed. FIG. 5 is a drawing representing a central position of an image by a sign when the central position of the image is changed in the order illustrated in FIG. 4.

Referring to FIGS. 3, 4, and 5, if a central position C of an image initially being displayed on the display panel 110 is C0, the central position C of the image is changed in the following order: C0=(0, 0), C1=(−1, 0), C2=(−1, 1), C3=(0, 1), C4=(1, 1), . . . , C47=(−2, −3), C48=(−3, −3). That is, the central position of the image is changed from (0, 0) in a spiral counterclockwise path. After the central position C of the image reaches (−3, −3), the central position C of the image is moved in reverse order. For instance, the central position C of the image is changed in the following order: C48=(−3, −3), C47=(−2, −3), C46=(−1, −3), C45=(0, −3), . . . , C1=(−1, 0), C0=(0, 0). The central position of the image moves by 1 pixel unit in a spiral path in order to minimize recognition of image movement of a user. A change order of the central position C of the image can be variously changed. In other exemplary embodiments, the central position C of the image may be changed in a spiral clockwise path. A distance unit that the central position C of the image moves is not limited to 1 pixel. For example, the central position C of the image can move by 2 or more pixel units.

FIGS. 6 through 10 are drawings illustrating examples of an image being displayed on a display panel as a central position of an image is changed.

Figure 6:
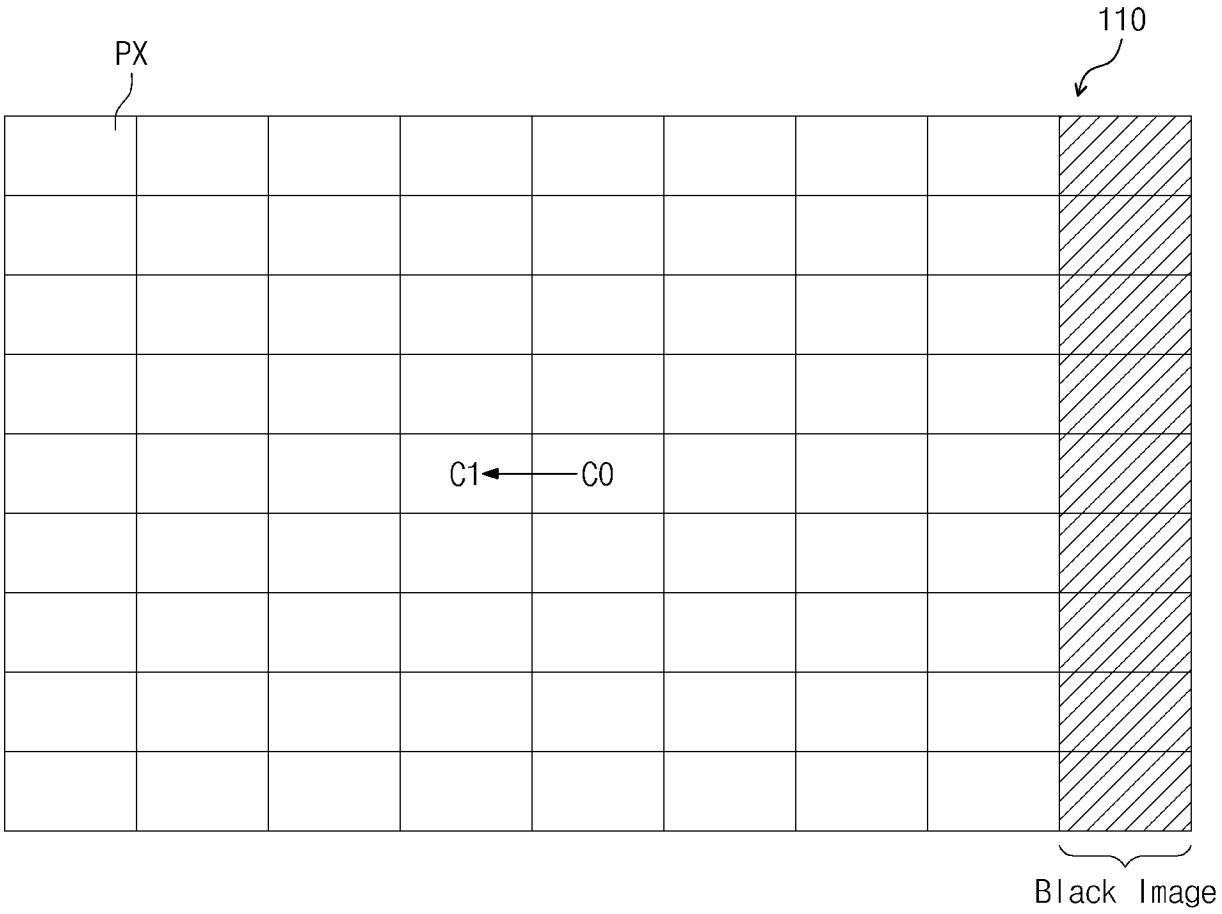
FIGS. 6 through 10 are drawings each illustrating an example of an image being displayed on a display panel as a central position of an image is progressively changed.

Referring to FIG. 6, when the central position of the image is changed from C0 to C1, the image shifter 240 illustrated in FIG. 2 changes a data signal DATA corresponding to the rightmost pixels of the display panel 110, of which coordinates are (4, −4)~(4, 4), into a signal corresponding to a black image. In this exemplary embodiment, as the central position of the image is changed from C0 to C1, data signal DATA to be provided to pixels having no images to be displayed is changed into a signal corresponding to a black image. However, the data signal DATA can be changed into a signal corresponding to a white color or any arbitrary color.

Figure 7:
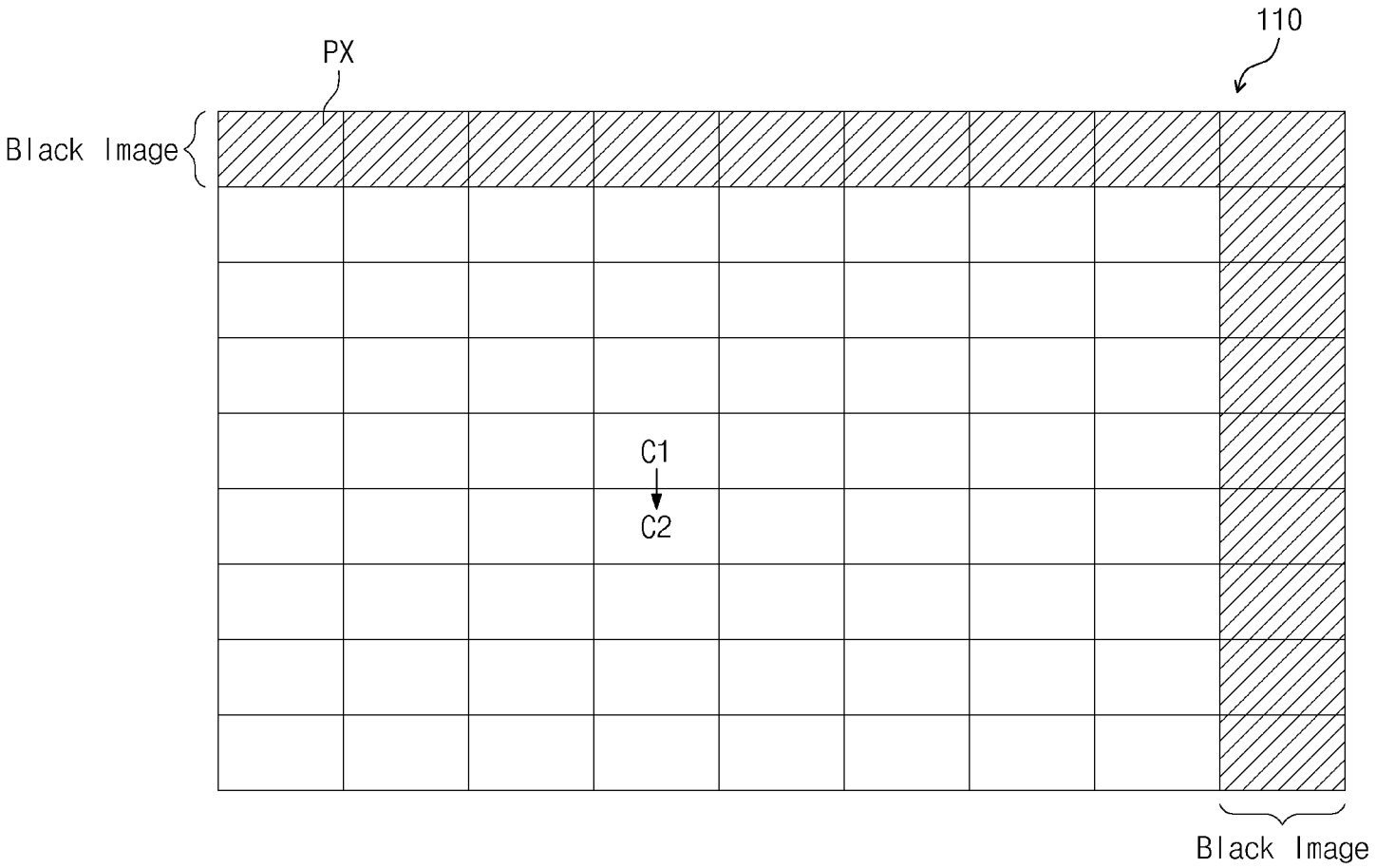

Referring to FIG. 7, when the central position of the image is changed from C1 to C2, the image shifter 240 changes a data signal DATA corresponding to the rightmost pixels of the display panel 110, of which the coordinates are (4, −4)~(4, 4), and the uppermost pixels of the display panel 110, of which the coordinates are (−4, −4)~(4, −4), into a signal corresponding to a black image.

Figure 8:
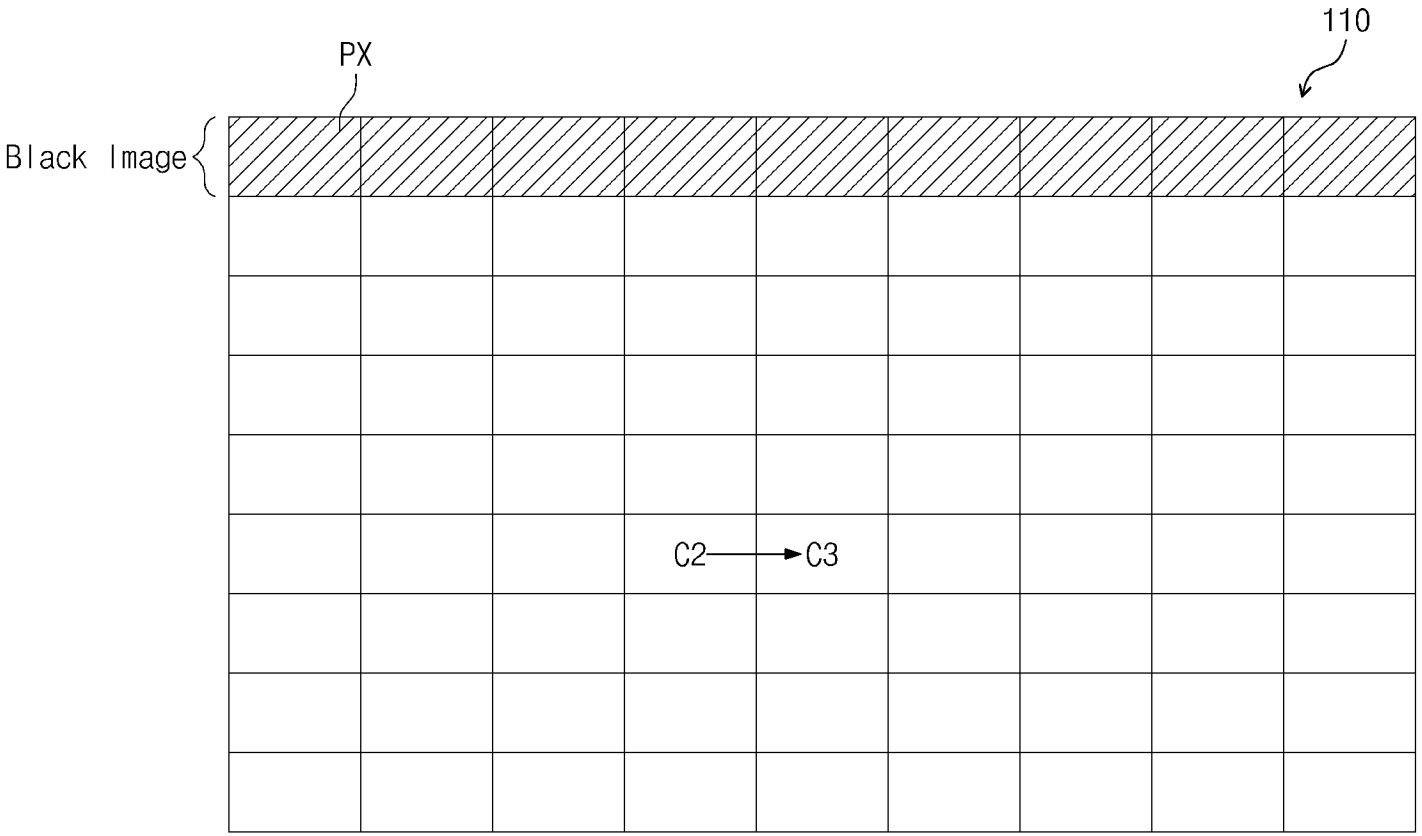

Referring to FIG. 8, when the central position of the image is changed from C2 to C3, the image shifter 240 changes a data signal DATA corresponding to the uppermost pixels of the display panel 110, of which the coordinates are (−4, −4)~(4, −4), into a signal corresponding to a black image.

Figure 9:
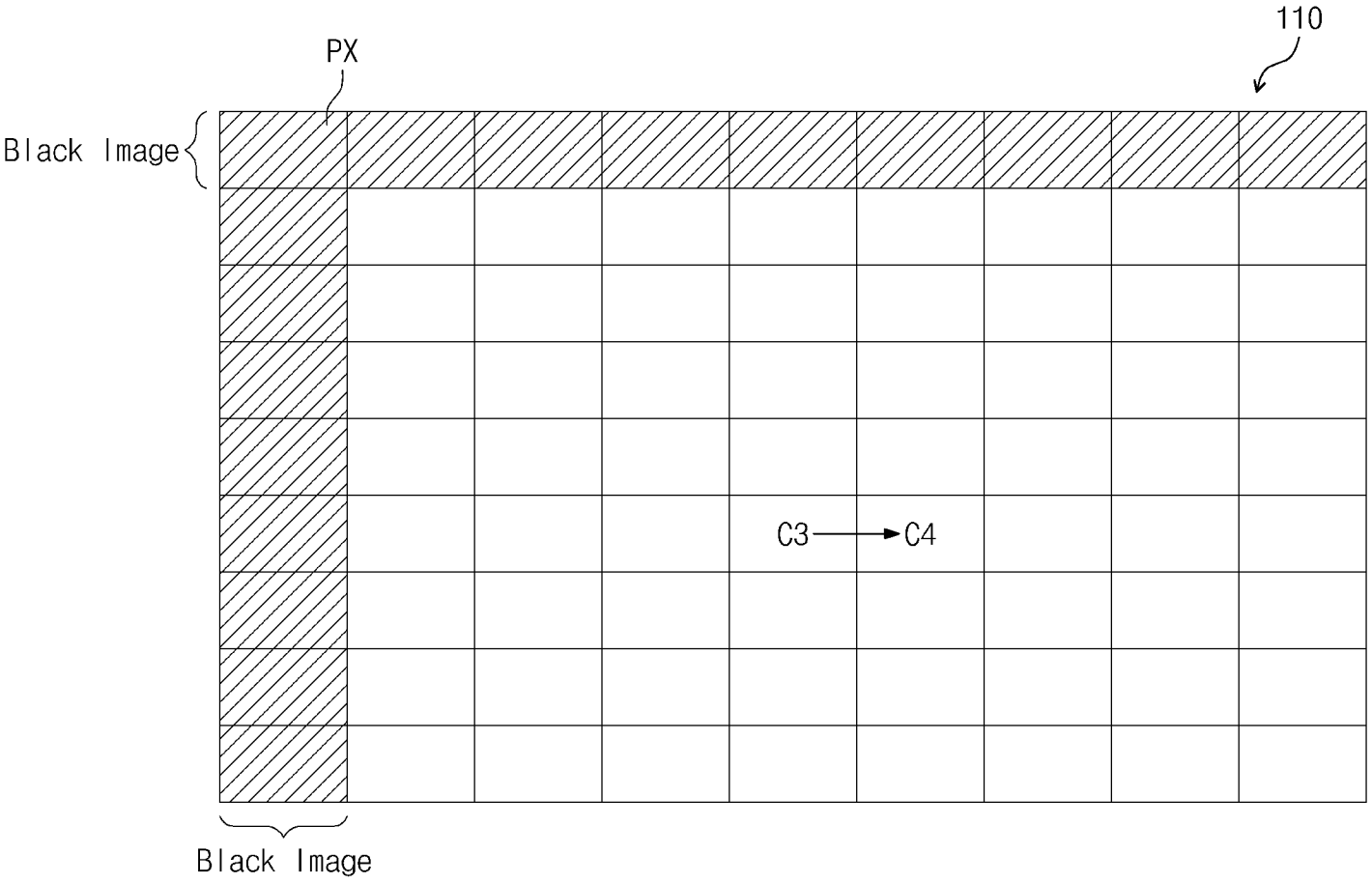

Referring to FIG. 9, when the central position of the image is changed from C3 to C4, the image shifter 240 changes a data signal DATA corresponding to the leftmost pixels of the display panel 110 of which the coordinates are (−4, −4)~(−4, 4) and the uppermost pixels of the display panel 110 of which the coordinates are (−4, −4)~(4, −4) into a signal corresponding to a black image.

Figure 10:
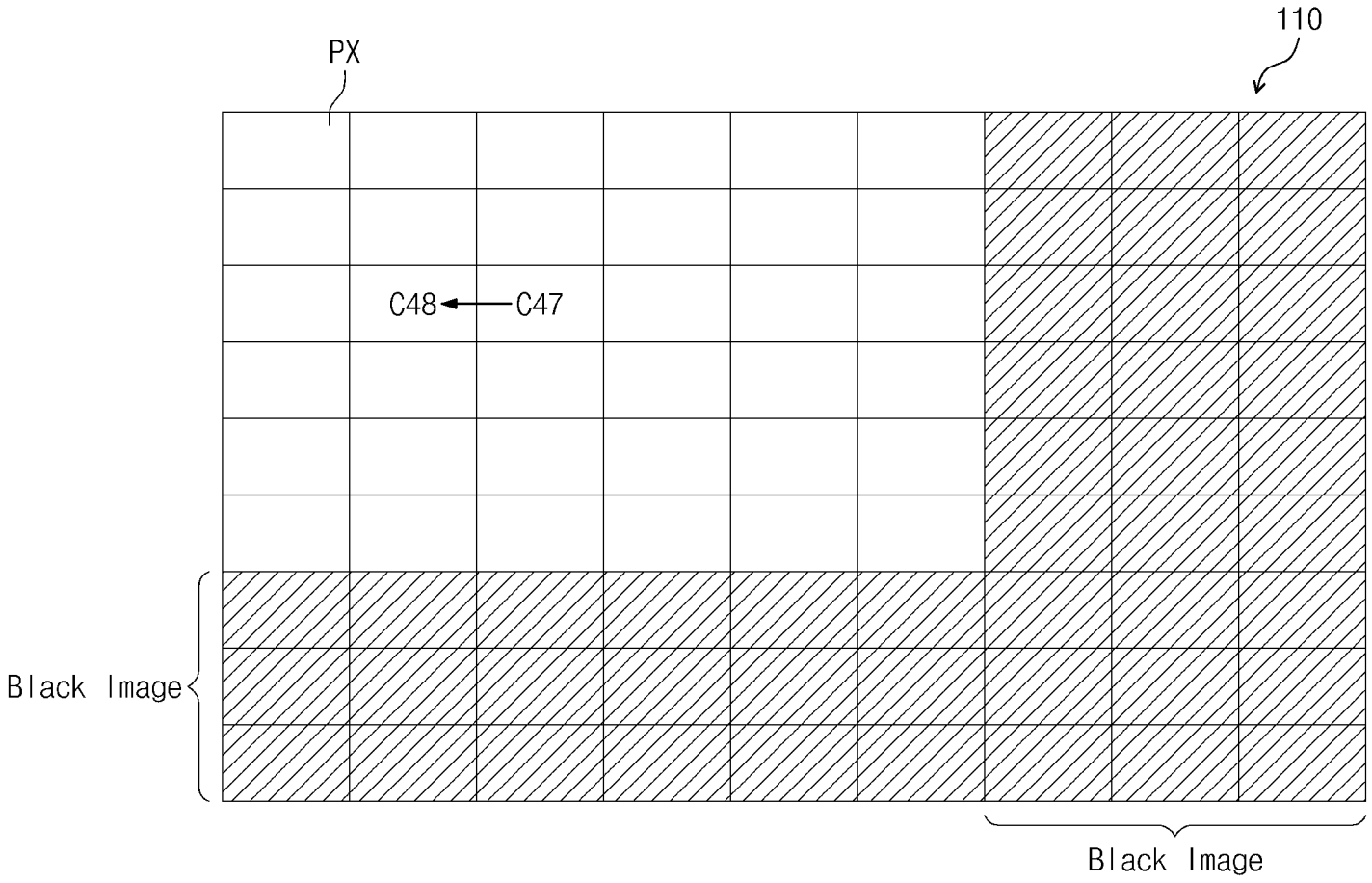

Referring to FIG. 10, when the central position of the image is changed from C47 to C48, the image shifter 240 changes a data signal DATA corresponding to lower pixels of the display panel 110 of which the coordinates are (−4, −2)~(1, 4) and right pixels of the display panel 110 of which the coordinates are (2, −4)~(4, 4) into a signal corresponding to a black image.

Figure 11:
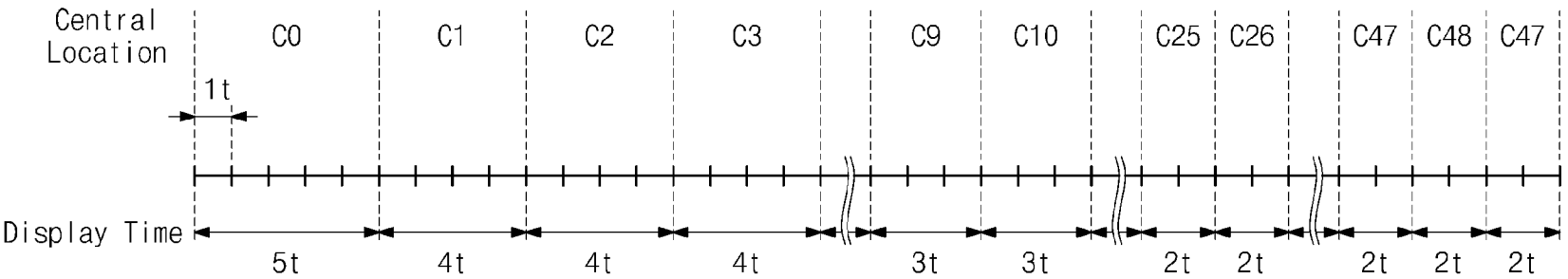
FIG. 11 is a drawing illustrating different times that an image is displayed at a changed central position when a central position of an image is changed in the order illustrated in FIG. 4.
Figure 12:
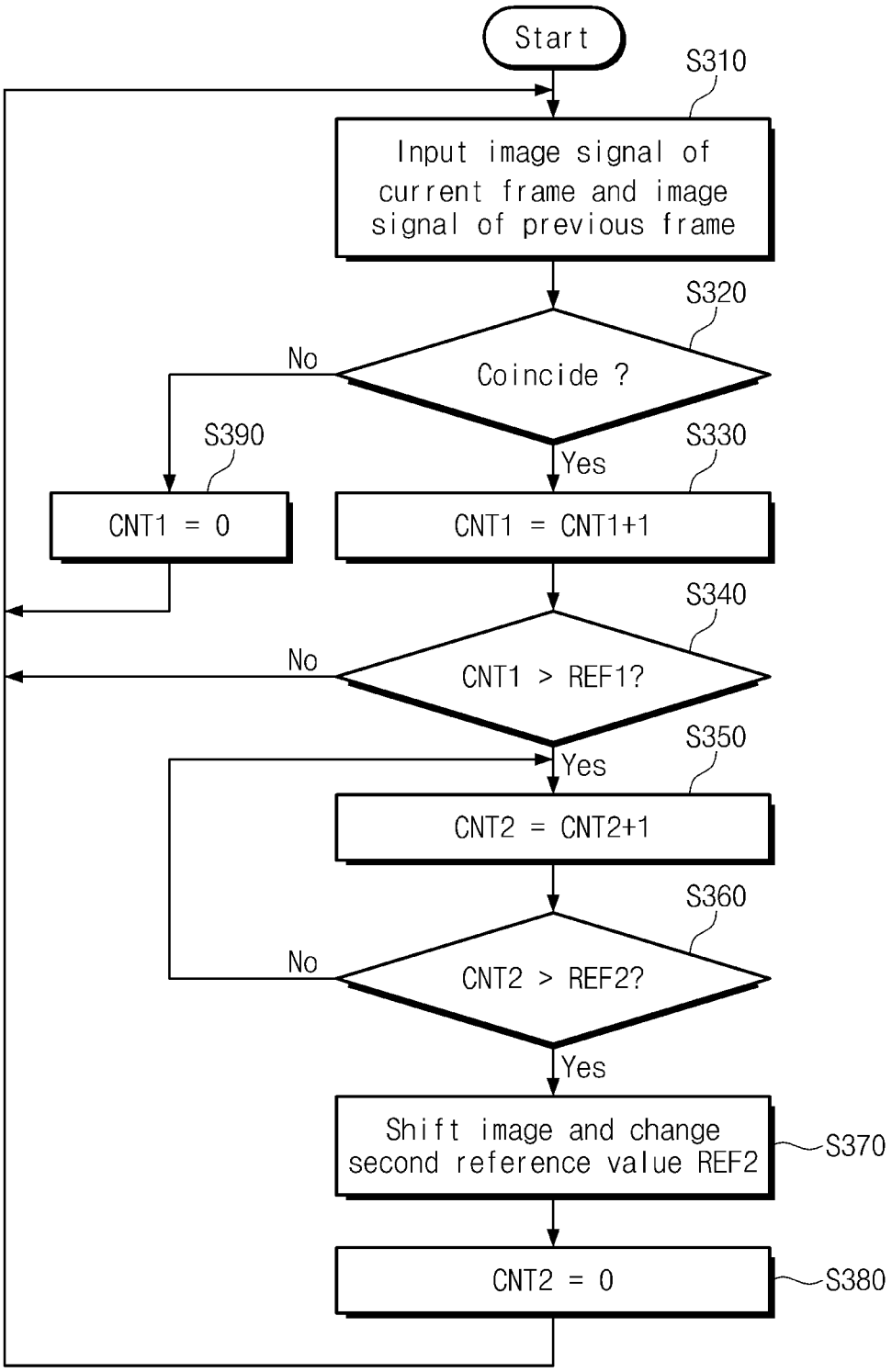
FIG. 12 is a flow chart illustrating a method of driving a display device in accordance with exemplary embodiments of the present invention.

FIG. 11 is a drawing illustrating a time that an image is displayed at a changed central position when a central position of an image is changed in the order illustrated in FIG. 4. FIG. 12 is a flow chart illustrating a method of driving a display device in accordance with exemplary embodiments of the inventive concept.

Referring to FIGS. 2, 3, 11, and 12, the central position C of the image is initially C0=(0, 0). The comparator 210 illustrated in FIG. 2 receives a current image signal RGBi and a previous image signal RGBi−1 (S310). When the current image signal RGBi does not coincide with the previous image signal RGBi−1 (S320), the comparator 210 outputs a first reset signal RST1 to the first counter 220. The first counter 220 resets a first count signal CNT1 to 0 (S390).

When the current image signal RGBi coincides with the previous image signal RGBi−1 (S320), the comparator 210 outputs a first count up signal UP1. In response to the first count up signal UP1, the first counter 220 outputs a first count signal CNT increased by 1 (S330).

The image shifter 240 compares a first count signal CNT1 with a first reference value REF1. The first reference value REF1 of the image shifter 240 can be set to a value configured to prevent occurrence of image retention when a still image is displayed for a long period of time. For instance, the first reference value REF1 can be set to a value corresponding to several hours.

If the first count signal CNT1 is greater than the first reference value REF1, the image shifter 240 outputs a second count up signal UP2. The second counter 230 outputs a second count up signal CNT2 that is increased by 1, in response to the second count up signal UP2 (S350).

The image shifter 240 compares the second count signal CNT from the second counter 230 with a second reference value REF2 (S360). Here, because a central position C of an image is C0=(0, 0), the second reference value REF2 is T=5t. That is, when the second count signal CNT2 is 5 (i.e., after 5 frames), the central position C of the image is changed from C0 to C1 to shift the image, and the second reference value REF2 is changed to 4t corresponding to the central position C1 (S370). The second reference value REF2 represents a time that a current image is displayed. In other words, the second reference value REF2 represents a "next position change time period" of the image. The image shifter 240 outputs a data signal DATA, in which the central position C of the image is changed from C0 to C1, and a second reset signal RST2 for resetting the second counter 230. The second count signal CNT2 of the second counter 230 is reset to 0 (S380).

The display device 100 of the present invention can minimize an image retention phenomenon produced by a previous image by moving the image incrementally, when the image being displayed on the display panel 110 is the same image for a relatively long period of time, An image retention effect caused by a visual recognition characteristic of a viewer, that is, a contrast sensitivity function, can be reduced by setting a different time period in which an image is displayed according to a moving distance of the image when changing a position of the image.

As illustrated in FIG. 3, an image retention effect can be minimized by reducing a time period in which an image is displayed at a moved position when a moving distance of the image is relatively long, and increasing a time period in which an image is displayed at a moved position when a moving distance of the image is relatively short.

When a still image is displayed for a relatively long period of time, the display device of the exemplary embodiment shifts the image for display. By setting a "next position change time period" of the image to be inversely proportional to a distance between an original position of the image and a changed position of the image, a user's sense of image retention can be minimized.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A display device comprising:

a display panel comprising pixels connected to gate lines and data lines; and an image display control unit configured to convert an image signal input from an external source into a data signal and drive the gate lines and the data lines so as to display an image corresponding to the data signal on the display panel, wherein the image display control unit is configured to output the data signal such that a position of the image on the display panel is changed when the input image signal is the same for a preselected period of time, and is configured to set a next position change time period of the image according to a distance between an original position of the image and a changed position of the image.

2. The display device of claim 1, wherein the image display control unit is configured to set a length of the next position change time period of the image in inverse proportion to a distance between the original position of the image and the changed position of the image.

3. The display device of claim 2, wherein:

the position of the image is changed from the original position by a pixel unit; and the image display control unit is configured to convert the image signal into a data signal configured to move the image toward left, right, top, bottom, left-top, left-right, right-top and right-bottom by k numbers of pixels (k is a positive integer) based on a central position of the display panel.

4. The display device of claim 2, wherein:

the position of the image is changed from the original position by a pixel unit; and the image display control unit is configured to convert the image signal into a data signal configured to move the image in a spiral path in the order of left, left-bottom, bottom, right-bottom, right, right-top, and top by a k numbers of pixels (k is a positive integer) based on a central position of the display panel.

5. The display device of claim 1, wherein the image display control unit comprises:

a gate driver configured to drive the gate lines;

a data driver configured to drive the data lines; and a timing controller configured to control the gate driver and the data driver and convert the image signal input from an external source into the data signal and provide the data signal to the data driver.

6. The display device of claim 5, wherein the timing controller comprises:

a comparator configured to receive the image signal of a previous frame as a previous image signal and the image signal of a current frame as a current image signal, and output a first count up signal when the previous image signal is the same as the current image signal;

a first counter configured to count in response to the first count up signal and output a first count signal;

an image shifter configured to output a second count up signal when the first count signal is greater than a first reference value; and a second counter configured to count in response to the second count up signal and output a second count signal, wherein the image shifter is configured to change a position of an image being displayed on the display panel when the second count signal is greater than a second reference value, and is configured to change the second reference value according to the distance between the original position of the image and the changed position of the image.

7. The display device of claim 6, wherein the comparator resets the first counter when the previous image signal differs from the current image signal.

8. The display device of claim 6, wherein the image shifter resets the second counter when the second count signal is greater than the second reference value.

9. The display panel of claim 6, wherein the image shifter is configured to output the data signal such that a black image is displayed on a pixel having no image when converting the image signal into the data signal, such that a position of the image on the display panel is changed.

10. The display panel of claim 6, further comprising a memory configured to store the current image signal and output the previous image signal.

11. A method of driving a display panel comprising:

receiving an image signal of a previous frame as a previous image signal and an image signal of a current frame as a current image signal;

counting up a first counter and outputting a first count signal when the previous image signal coincides with the current image signal;

counting up a second counter and outputting a second count signal when the first count signal is greater than a first reference value;

converting the current image signal into a data signal such that a position of an image being displayed on the display panel is changed when the second count signal is greater than a second reference value; and changing the second reference value according to a distance between an original position of the image and the changed position of the image.

12. The method of driving a display panel of claim 11, wherein the changing the second reference value comprises setting a next position change time period of the image in inverse proportion to a distance between the original position of the image and the changed position of the image.

13. The method of driving a display panel of claim 12, wherein the converting the current image signal into the data signal comprises converting the current image signal into the data signal such that the image moves toward left, right, top, bottom, left-top, left-right, right-top and right-bottom by k numbers of pixels (k is a positive integer) based on a central position of the display panel.

14. The method of driving a display panel of claim 12, wherein the converting the current image signal into the data signal comprises converting the image signal into a data signal such that the image moves in a spiral path in the order of left, left-bottom, bottom, right-bottom, right, right-top and top by k numbers of pixels (k is a positive integer) based on a central position of the display panel.

15. The method of driving a display panel of claim 11, further comprising resetting the first counter when the previous image signal differs from the current image signal.

16. The method of driving a display panel of claim 15, further comprising resetting the second counter when the second count signal is greater than the second reference value.

17. The method of driving a display panel of claim 11, wherein the converting the current image signal into the data signal comprises outputting the data signal such that black is displayed on a pixel where the image is not displayed when converting the image signal into the data signal such that a position of the image being displayed on the display panel is changed.

18. A display device comprising:

a display panel comprising pixels connected to gate lines and data lines; and an image display control unit configured to convert sequentially input image signals into data signals and drive the gate lines and the data lines so as to display images corresponding to the data signals on the display panel, wherein the image display control unit is configured to output the data signals so that a position of the image displayed on the display panel is changed when the image signals being sequentially input from an external source are the same for a preselected period of time, and sets a length of a next position change time period of the image in inverse proportion to a distance between an original position of the image and a changed position of the image.

* * * * *